US010144045B2

(12) United States Patent
Mayrhofer

(10) Patent No.: US 10,144,045 B2
(45) Date of Patent: Dec. 4, 2018

(54) BENDING TOOL

(71) Applicant: TRUMPF Maschinen Austria GmbH & Co. KG., Pasching (AT)

(72) Inventor: Johann Mayrhofer, Nussbach (AT)

(73) Assignee: TRUMPF Maschinen Austria GmbH & Co. KG., Pasching (AT)

( * ) Notice: Subject to any disclaimer, the term of this patent is extended or adjusted under 35 U.S.C. 154(b) by 441 days.

(21) Appl. No.: 14/899,597

(22) PCT Filed: Jun. 17, 2014

(86) PCT No.: PCT/AT2014/050135

§ 371 (c)(1),
(2) Date: Jan. 28, 2016

(87) PCT Pub. No.: WO2014/201489

PCT Pub. Date: Dec. 24, 2014

(65) Prior Publication Data

US 2016/0136706 A1 May 19, 2016

(30) Foreign Application Priority Data

Jun. 20, 2013 (AU) ..... A 50403/2013

(51) Int. Cl.
*B21D 37/14* (2006.01)
*B21D 5/02* (2006.01)

(52) U.S. Cl.
CPC ..... *B21D 5/0236* (2013.01); *B21D 5/0254* (2013.01); *B21D 37/14* (2013.01)

(58) Field of Classification Search
CPC .... B23Q 3/1556; B21D 5/236; B21D 5/0209; B21D 5/0236; B21D 5/02; B21D 37/14; B21D 5/0254

(Continued)

(56) References Cited

U.S. PATENT DOCUMENTS 5,245,854 A * 9/1993 Bruggink ..... B21D 5/0236 72/462
6,467,327 B1 * 10/2002 Runk ..... B21D 5/0209 72/389.9

(Continued)

FOREIGN PATENT DOCUMENTS

AT 511591 A1 1/2013
EP 1 862 233 A1 12/2007

(Continued)

OTHER PUBLICATIONS

International Search Report of PCT/AT2014/050135, dated Oct. 1, 2014.

*Primary Examiner* — David B Jones
(74) *Attorney, Agent, or Firm* — Collard & Roe, P.C.

(57) ABSTRACT

The invention relates to a bending tool (3) for inserting into a tool mount (2). The bending tool comprises a tool body (4), a locking element (8) which is connected to an activating element (7) accessible outside of the tool mount (2) and which has a locking tab (9) for securing the bending tool (3) in the tool mount (2) by engaging in a recess arranged therein, wherein a base position of the activating element (12) corresponds to a unlocking position of the locking element (16) and an actuating position of the activating element (13) corresponds to a locking position of the locking element (15). Furthermore, there is a tool position securing element (17) attached displaceably in the tool body (4), which tool position securing element, in a securing position (18) that protrudes with respect to the tool body (4), establishes a connection for fixing the position of the tool body (4) with respect to a displacement direction (5) in the tool mount (2). Both the locking element (8) and the tool position securing element (17) are connected to the same activating element (7).

11 Claims, 4 Drawing Sheets

(58) Field of Classification Search
USPC ..... 72/481.1
See application file for complete search history.

(56) References Cited

U.S. PATENT DOCUMENTS

| | | | | |
|---|---|---|---|---|
| 6,843,760 | B2 * | 1/2005 | Akami | B21D 5/02 483/28 |
| 6,928,852 | B2 * | 8/2005 | Enderink | B21D 5/0209 72/389.4 |
| 7,632,224 | B2 * | 12/2009 | Rouweler | B23Q 3/1556 294/94 |
| 7,810,369 | B2 | 10/2010 | Rouweler et al. | |
| 8,099,992 | B2 | 1/2012 | Rouweler et al. | |
| 9,254,517 | B2 * | 2/2016 | Sato | B21D 5/0236 |
| 2006/0277970 | A1 | 12/2006 | Pabich et al. | |
| 2007/0144232 | A1 | 6/2007 | Shimota et al. | |

FOREIGN PATENT DOCUMENTS

| | | | |
|---|---|---|---|
| WO | 2004/024361 | A1 | 3/2004 |
| WO | 2004/101188 | A1 | 11/2004 |
| WO | 2006/135835 | A2 | 12/2006 |
| WO | 2007/054121 | A1 | 5/2007 |

* cited by examiner

BENDING TOOL

CROSS REFERENCE TO RELATED APPLICATIONS

This application is the National Stage of PCT/AT2014/050135 filed on Jun. 17, 2014, which claims priority under 35 U.S.C. § 119 of Austrian Application No. A 5040/013 filed on Jun. 20, 2013, the disclosure of which is incorporated by reference. The international application under PCT article 21(2) was not published in English.

The invention relates to a bending tool for inserting into a tool mount as well as elements for securing said bending tool, as described in the independent claim 1.

Embodiments of bending tools are known in which the bending tool can be inserted into the tool mount from below by means of a rapid clamping system, whereby it does not need to be pushed laterally into the latter and is moved by displacement into the intended position. Bending tools are also known in which a securing element is provided which prevents lateral sliding in the tool mount in an untensioned state.

From WO 2006/135835 a bending tool is known which contains a locking element, in order to be inserted from below into a tool mount and also to be removable downwards out of the tool mount. Said locking element can be activated by means of a push button which is attached on the side of the bending tool. In addition, a clamping element is provided which is designed to secure the bending tool inserted in the tool mount in horizontal direction from sliding. The clamping element provides a force because of a lateral application and thus friction relative to the tool mount. The activation of said securing element is performed by an additional activating element, which is attached laterally on the bending tool. In order to insert a bending tool into the tool mount, both activating elements attached to the sides of the bending element have to be pushed by the operator.

A disadvantage of the known embodiment is that to insert the bending tool both activating elements have to be pushed. In this way the freedom of handling of the operator to perform additional actions and manipulations is extremely limited. Furthermore, it is considered disadvantageous that if both activating elements are not pushed at the same time and fully this may result in the jamming of the bending tool, whereby it may occur that the bending tool is inserted obliquely and thus in an undefined position in the tool mount. If the operator is careless and lets go of the tool this may cause the bending tool to fall down and injure the operator.

From EP 1 862 233 A1, AT 511 591 A4 and US 2007/144232 A1 bending tools are also known which can be inserted into a tool mount.

The underlying objective of the present invention is to develop a bending tool for rapid insertion into a tool mount such that the latter can be operated easily and simply, and any safety risks caused by jamming can be reduced as far as possible. Also in the case of automated production it is absolutely necessary that a bending tool, which has been inserted by a manipulator into the tool mount, is not set undesirably in its position in the tool mount after the insertion process. This is particularly important if the produced parts need to be very precise.

Said objective of the invention is achieved by the features or measures according to claim 1. In particular, the coupling of the tool position securing element and the locking element on a common activating element enables the simple operation and handling of the bending tool. In this way it is possible that the second hand of the operator can be used for other tasks.

According to the invention a bending tool is designed for inserting into a tool mount. The latter comprises a tool body, a locking element coupled to an activating element accessible outside the tool mount with a locking tab for securing the bending tool in the tool mount by engaging in a recess arranged therein, wherein a basic position of the activating element corresponds with an unlocking position of the locking elements and an activating position of the activating element corresponds with a locking position of the locking element. Furthermore, a tool position securing element attached displaceably in the tool body is provided which in a securing position protruding relative to the tool body forms a connection for fixing the position of the tool body relative to a displacement direction in the tool mount. Both the locking element and the tool position securing element are coupled to the same activating element.

An advantage of the design according to the invention is that a locking element is provided which secures the tool from falling out of the tool mount, and which can be moved away for simply removing the tool from said tool mount as well as a tool position securing element, which secures the tool from sliding in the tool mount. It is particularly advantageous in this case that the locking element and also the tool position securing element can only be moved together by one activating element.

Furthermore, it can be advantageous if the tool position securing element is connected via the locking element to the activating element. The advantage of this is that the locking element, which is moved by the activating element, is used for transmitting the movement to the tool position securing element, and thus no additional components are necessary. In this way it is possible to have a mechanical design which is as simple as possible, can be produced inexpensively and is less prone to failure even during the assembly of the parts.

Alternatively, it is possible that both the tool position securing element and the locking element are connected directly to the activating element. It is an advantage here that in the design of the locking elements no attention needs to be paid to the tool position securing element, in order to move this as described above by means of the locking element. The locking element can thus be designed to be very small in its extension. However, the form of the tool position securing element or the form of the activating element has to be reconfigured such that the latter are in mechanical contact with one another.

Furthermore, it can be advantageous that the locking element and the tool position securing element are movably coupled to one another by means of a mechanical connection. It is an advantage here that a mechanical connection is easy to form in terms of manufacturing technology and that the latter is also less prone to faults.

Alternatively, it is possible that the locking element and the tool position securing element are movably coupled to one another by an essentially incompressible fluid. It is an advantage in this case that by activating by fluid no structural restrictions by transmitting elements in the tool are necessary. The transmission of force takes place in this case via the fluid in that the activating element transmits the force to the fluid via the active surface, and thus places the latter under pressure. The pressure of the fluid is transmitted via channels or lines in the bending tool to the active surfaces of the locking element or the tool position securing element and thus applies a force which can be converted into a movement.

Furthermore, it is possible that the tool position securing element has a frictional surface for producing a non-positive connection with the tool mount. It is an advantage here that by forming a non-positive connection between the bending tool and tool mount by means of a frictional surface, the bending tool can be positioned in any position along the tool mount.

Furthermore, it also possible that the tool position securing element is pretensioned by a spring element in the direction of the securing position. It is particularly advantageous in this case that in this way in the inactivated state of the activating element the tool position securing element is located in its securing position. Therefore, the activating button of the activating element only needs to be released in order to fix and secure the bending tool in position.

According to an advantageous development it is possible for the spring element to be a leaf spring, which is oriented in adjusting direction of the tool position securing element and can be bent and thus shortened by a force applied transversely to the longitudinal extension of the leaf spring. It is particularly advantageous in this case that the leaf spring can apply in a virtually extended state a very high operating force along the longitudinal extension of the leaf spring compared to a transverse activating force. In this way a good translation can be achieved, whereby the activating element can be so smooth that it can also be pushed by hand, but still sufficient force can be applied onto the tool position securing element.

Alternatively, it is possible that the spring element is formed by a helical spring. It is an advantage in this case that a helical spring is simple to apply and that the precision requirements of the mount of the tool position securing element in the tool body of the bending tool are rather low. Furthermore, helical springs in the envisaged form are commercially available products that can be acquired inexpensively and easily.

Furthermore, it is possible that the tool position securing element in a recess between the two ends has a surface which is angled to a direction of movement of the tool position securing element, which surface is contacted by an activating tab of the locking element or the activating element. It is an advantage here that in this way a helical spring or similar spring can be used which applies a force only in axial direction. By means of the angled surface a translation of the force and the movement of the locking element on the tool position securing element is achieved.

It is also advantageous to have an impression in which the tool position securing element is designed to be circular cylindrical and is guided in a bore in the tool body. By means of said impression a simple and inexpensive mass production is possible.

For a better understanding of the invention the latter is explained in more detail with reference to the following Figures.

In a much simplified schematic representation:

Figure 1:
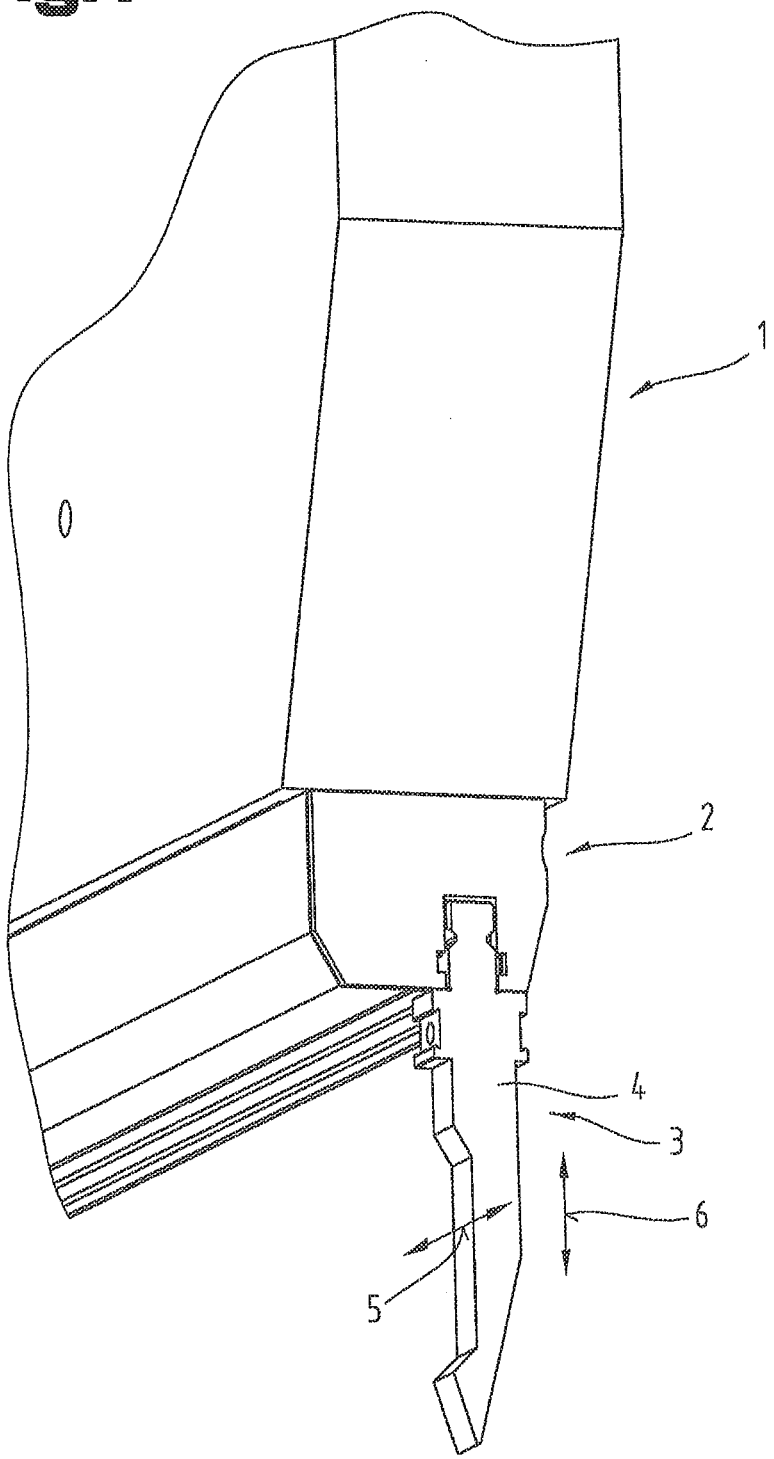
FIG. 1 is a perspective view of a bending tool which is mounted in the upper press bar.

First of all, it should be noted that in the variously described exemplary embodiments the same parts have been given the same reference numerals and the same component names, whereby the disclosures contained throughout the entire description can be applied to the same parts with the same reference numerals and same component names. Also details relating to position used in the description, such as e.g. top, bottom, side etc. relate to the currently described and represented figure and in case of a change in position should be adjusted to the new position.

FIG. 1 shows a press bar 1 and a tool mount 2 arranged thereon, with a mounted bending tool 3 in perspective view. The tool body 4 is shown particularly clearly, which during the bending process engages in the sheet metal to be bent. The bending tool 3 can be positioned in the tool mount 2 in horizontal displacement direction 5. For this the bending tool 3 has to be inserted in horizontal displacement direction 5 laterally into the tool mount 2 of the press bar 1.

Alternatively, it is also possible to introduce the bending tool 3 in a vertical insertion direction 6 into the tool mount 2. In this case to insert the bending tool 3 into the tool mount 2 it is necessary to configure the bending tool 3 as shown in the following Figures. By means of the elements described below it is possible to ensure the simple insertion of the bending tool 3 in vertical insertion direction 6.

In the tool mount 2 a plurality of bending tools 3 can be positioned which are designed to be similar and adjoin one another and thus form a long processing edge. It is also possible to position a plurality of different bending tools 3 in the tool mount 2. Said different bending tools 3 are then used for different bending processes and can also be exchanged individually. If bending tools 3 of different kinds are used for different operating steps, it is usual to arrange the latter a certain distance apart.

Figure 2:
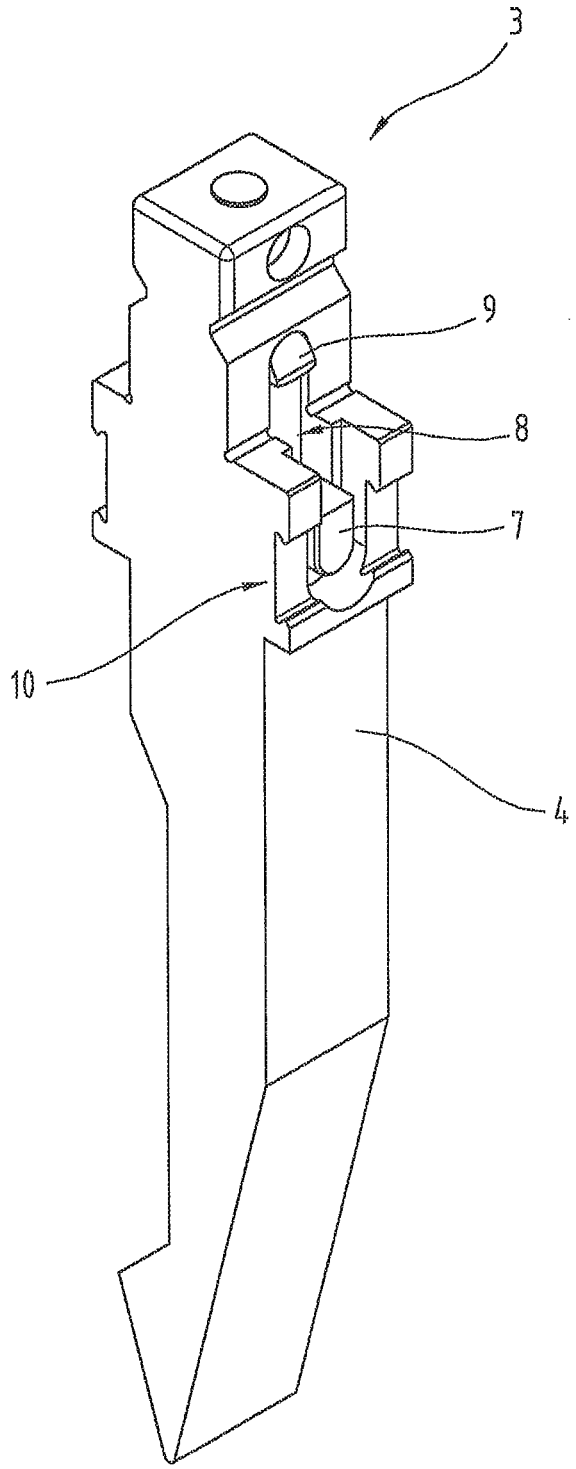
FIG. 2 is a perspective view of a bending tool.

FIG. 2 shows a bending tool 3 in perspective view. Here the activating element 7 is shown in particular, which is coupled to the locking element 8. There is also a clear view of the locking tab 9 of the locking element 8, which can be moved out of the tool body 4 and can thus engage in the tool mount 2. A recess 10 is also shown, also referred as a gripping groove, which in the tool body 4 has such a shape that a manipulator for changing the bending tool can engage in said recess, and can thus insert and remove the bending tool. Here it is not absolutely necessary for said recess 10 to be designed in the form of a groove, but it is also possible for example to have a simple bore, into which a manipulator can engage. Said manipulator can be a robot arm, which is provided for handling the metal sheets to be bent. It is also possible however that the manipulator is a rear stop device for example which is used for the tool exchange.

There are two ways of fitting a bending tool 3. On the one hand the fitting can be performed manually, whereby a user inserts the bending tool 3 into the tool mount 2. On the other hand it is also possible that a manipulator is used to insert the bending tool 3 into the tool mount 2. In both cases the activating element 7 has to be pushed in order to enable the positioning of the bending tool 3 in the tool mount.

Figure 3:
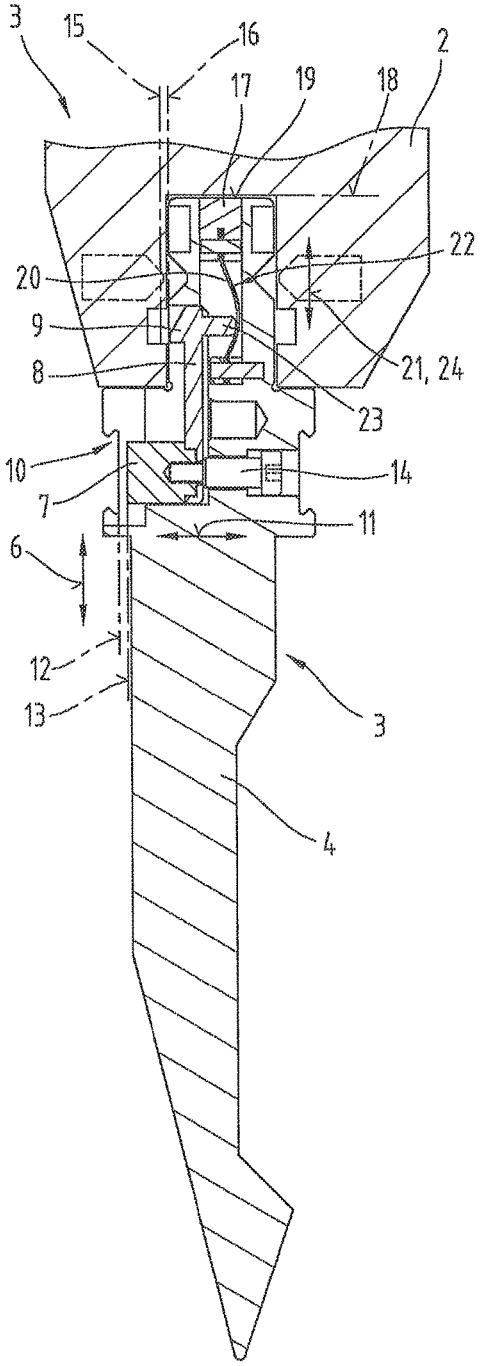
FIG. 3 is a cross section of a bending tool, which is in a position in which it can be inserted freely into the tool mount.

FIG. 3 shows a cross-section through a bending tool 3 in a position of the activating element 7 in which the bending tool 3 is moved straight into the tool body 4 in vertical insertion direction 6. Here the activating element 7 is pushed into the tool body 4. Thus the free movability of the bending tool 3 in the tool mount 2 is ensured. The exact mechanisms are described in the following which are implemented by activating the activating element 7.

There are different ways in which the activating element 7 can be activated. On the one hand it is possible to insert the bending tool 3 manually into the tool mount 2, whereby the activating element 7 is pushed by a finger of the operator. On the other hand in an automated tool exchange a gripping element can engage in the recess 10, whereby at the same time it pushes the activating element 7. The activating element 7 is preferably designed so that it is guided directly in the tool body 4 and thus can only be moved in an activating direction 11. This movement of the activating element 7 along an activating direction 11 can take place between a basic position of the activating element 12 and an activating position of the activating element 13. In the basic position of the activating element 12 this is not activated and the bending tool 3 is secured by the locking tab 8 from falling out of the tool mount. In the activating position of the activating element 13 the latter is pushed in and the internal mechanisms mean that the bending. tool 3 can be displaced freely in the tool mount 2 with a release of the clamping of the tool mount 2, or can be removed out of the latter in vertical insertion direction 6.

The locking element 8 is attached directly onto the activating element 7 which locking element is fixed by means of a securing element 14, for example a hexagon socket screw. The locking element 8 is thus coupled directly to the movement of the activating element 7 and is thus also displaceable in activating direction 11. By means of this displacement of the locking element 8 between a locking position 15 of the locking element 8 and an unlocking position 16 of the locking elements 8 it is possible that the locking tab 9 engages either in a securing groove/holding groove of the tool mount 2 or that the latter does not engages in the securing groove, whereby it is possible to remove the bending tool 3.

A tool position securing element 17 is also shown which secures the bending tool 3 against unwanted displacement in displacement direction 5 in the tool mount 2, as long as the actual tool clamp, by means of which the bending tool 3 is tensioned fixed in the tool mount, is not yet activated. The securing of the bending tool 3 is ensured when the tool position securing element 17 is located in its securing position 18 projecting outwardly relative to the tool body 4. In this case a frictional surface 19 of the tool position securing element 17 forms a frictional connection to the tool mount 2. The production of said non-positive connection functions in that the tool position securing element 17 is pushed by a spring element 20 in the direction of the securing position 18 and in this way a normal force is applied between the tool mount 2 and frictional surface 19, which leads by friction to a frictional force parallel to the surface. This resulting frictional force secures the bending tool 3 from sliding in displacement direction 5.

Preferably, the tool position securing element 17 is designed to be circular cylindrical and can thus be moved in a bore 22 of the tool body 4 in adjusting direction of the tool position securing element 21. At the end of the tool position securing element 17 inside the tool body 4 by means of a securing means the spring element 20 is attached in the form of a leaf spring.

The activation of the tool position securing element 17 is performed in that the spring element 20 in the form of the leaf spring is pushed by an activating tab 23 of the locking element 8 transversely to the longitudinal extension 24 of the leaf spring and the latter thus shortens in length. In this way the tool position securing element 17 is moved out of its securing position 18 in the direction of the tool body 4. The frictional connection between the frictional surface 19 and the tool mount 2 is interrupted.

FIG. 3 shows a cross section of a bending tool 3, in which the tool position securing element 17 is drawn completely into the tool body 4, and thus allows the free movement of the bending tool 3.

It is also possible that, not as shown in FIG. 3, the activating element 7 is coupled directly to the locking element 8 and the locking element 8 is coupled via a spring element 20 to the tool position securing element 17, but that the tool position securing element 17 and the locking element 8 are coupled individually to the activating element 7 respectively.

It is also possible that the activating element 7 transmits the activating movement and thus the activating force not by means of a mechanical connection to the locking element 8 and the tool position securing element 17 but a hydraulic system is connected in between on which the activating element 7 applies a force and which transmits said force to the tool position securing element 17 and to the locking element 8.

Figure 4:
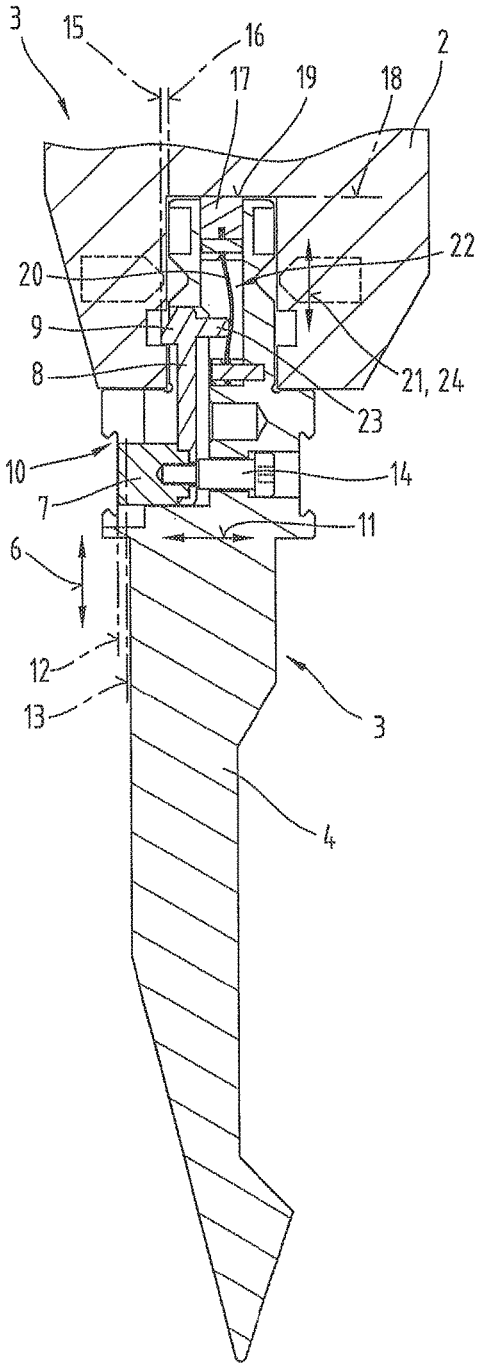
FIG. 4 is a cross-section of a bending tool, which is in a position in which it is secured in the tool mount against displacement.

FIG. 4 shows the bending tool 3 as inserted in the tool mount 2 and locked so that it is secured in its position and can also not be removed from the tool mount 2. This position is the position in which the bending tool 3 is located after being fitted, before it is tensioned by the tool mount and is thus ready for operation. In this case the activating element 7 is not pushed, whereby the locking element 8 is located in the locking position 15 of the locking element 8. The locking element 8, activating element 7 and the tool position securing element 17 are thereby held in the position shown in FIG. 4 such that the leaf spring applies a force, in order to return back to its original, flat or extended initial position. By means of this effect it is possible on the one hand that the tool position securing element 17 is pushed upwards and thus into its securing position 18. On the other hand the leaf spring pushes on the activating tab 23 of the locking element 8 and thus applies a force in order to move the latter into the shown position. By means of these effects it is achieved that the frictional surface 19 is in contact with the tool mount 2, whereby a frictional force is produced which secures the position of the bending tool.

It is also possible that the tool position securing element 17 and the tool mount 2 have a fine toothing on surfaces in contact with one another in the securing position 18, and thus the securing of the bending tool 3 against unwanted sliding is ensured in displacement direction 5 by positive locking.

Figure 5:
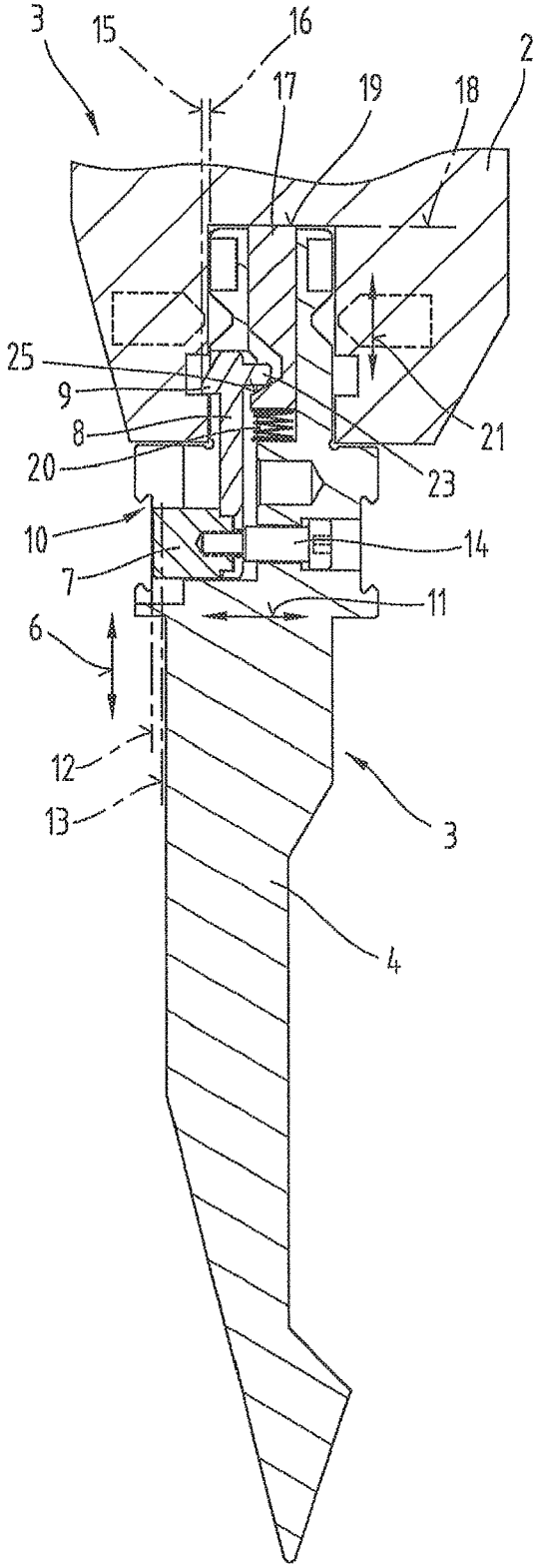
FIG. 5 is a further embodiment of a bending tool in which a helical spring is used for the locking mechanism instead of a leaf spring.

FIG. 5 shows a further and possibly independent embodiment of the bending tool 3, wherein the same reference numerals and component names have been used for the same parts as in the preceding FIG. 1-4. To avoid unnecessary repetition reference is made to the detailed description for the preceding FIG. 1-4.

In the embodiment according to FIG. 5 the tool position securing element 17 extends below the activating tab 23 of the locking element 8. In this case a helical spring is arranged as a spring element 20 underneath the tool position securing element 17. Said helical spring tries to push the tool position securing element 17 upwards in the direction of the tool mount 2. By applying a force on the activating element 7 and thus transmitting said force onto the locking element 8, which engages with its activating tab 23 in a lateral recess in the tool position securing element 17 and in the recess contacts a surface 25 running obliquely to the adjusting direction 21 of the tool position securing element 17, it is possible that the latter is moved out of its securing position 18.

If the force on the activating element 7 is removed the spring element 20 in the form of a helical spring can move the tool position securing element 17 in the direction of the securing position 18, whereby the activating tab 23 of the locking element 8 is pushed out over the angled surface 25 out of the tool position securing element 17. At the same time the activating element 7 is pushed by the locking element 8 into its basic position.

The exemplary embodiments show possible embodiment variants of the bending tool 3, whereby it should be noted at this point that the invention is not restricted to the embodiment variants shown in particular, but rather various different combinations of the individual embodiment variants are also possible and this variability, due to the teaching on technical procedure, lies within the ability of a person skilled in the art in this technical field.

Furthermore, also individual features or combinations of features of the shown and described different example embodiments can represent in themselves, independent solutions according to the invention.

The underlying objective of the independent solutions according to the invention can be taken from the description.

All of the details relating to value ranges in the present description are defined such that the latter include any and all part ranges, e.g. a range of 1 to 10 means that all part ranges, starting from the lower limit of 1 to the upper limit 10 are included, i.e. the whole part range beginning with a lower limit of 1 or above and ending at an upper limit of 10 or less, e.g. 1 to 1.7, or 3.2 to 8.1 or 5.5 to 10.

Mainly the individual embodiments shown in FIGS. 1-5 can form the subject matter of independent solutions according to the invention. The objectives and solutions according to the invention relating thereto can be taken from the detailed descriptions of these figures.

Finally, as a point of formality, it should be noted that for a better understanding of the structure of the bending tool 3 the latter and its components have not been represented true to scale in part and/or have been enlarged and/or reduced in size.

LIST OF REFERENCE NUMERALS

1 press bar
2 tool mount
3 bending tool
4 tool body
5 displacement direction
6 vertical insertion direction
7 activating element
8 locking element
9 locking tab
10 recess
11 activating direction.
12 basic position of the activating element
13 activating position of the activating element
14 securing element
15 locking position
16 unlocking position
17 tool position securing element
18 securing position
19 frictional surface
20 spring element
21 adjusting direction
22 bore
23 activating tab
24 longitudinal extension
25 angled surface

The invention claimed is:

1. An assembly comprising a tool mount and a bending tool insertable into the tool mount;

wherein the tool mount comprises a recess;

wherein the bending tool comprises a tool body;

a tool position securing element attached displaceably in the tool body;

an activating element accessible outside the tool mount; and a locking element coupled to the activating element and comprising a locking tab for securing the bending tool in the tool mount by engaging in the recess;

wherein the activating element has a basic position corresponding with an unlocking position of the locking element and an activating position corresponding with a locking position of the locking element;

wherein the tool position securing element has a securing position wherein the tool position securing element protrudes relative to the tool body and forms a connection for fixing the tool body in the tool mount in a position relative to a displacement direction; and wherein both the locking element and the tool position securing element are coupled to the activating element.

2. The assembly as claimed in claim 1, wherein the tool position securing element is coupled to the activating element via the locking element.

3. The assembly as claimed in claim 1, wherein both the tool position securing element and the locking element are coupled directly to the activating element.

4. The assembly as claimed in claim 1, wherein the locking element and the tool position securing element are movably coupled to one another by a mechanical connection.

5. The assembly as claimed in claim 1, wherein the locking element and the tool position securing element are movably coupled by an essentially incompressible fluid.

6. The assembly as claimed in claim 1, wherein the tool position securing element has a frictional surface for forming a non-positive connection with the tool mount.

7. The assembly as claimed in claim 1, further comprising a spring element pretensioning the tool position securing element toward the securing position.

8. The assembly as claimed in claim 7, wherein the spring element is a leaf spring oriented in an adjusting direction of the tool position securing element and bendable by a force applied transversely to a longitudinal extension of the leaf spring to shorten a distance the leaf spring extends longitudinally.

9. The assembly as claimed in claim 7, wherein the spring element is formed by a helical spring.

10. The assembly as claimed in claim 7, wherein the tool position securing element has first and second ends and a surface between the first and second ends, wherein the surface is angled relative to a direction of movement of the tool position securing element and contacted by an activating tab of the locking element or the activating element.

11. The assembly as claimed in claim 1, wherein the tool position securing element is designed to be circular cylindrical and is guided in a bore in the tool body.

* * * * *